United States Patent [19]

Enomoto

[11] 4,455,199

[45] * Jun. 19, 1984

[54] METHOD OF MANUFACTURING A TIMEPIECE COMPONENT

[75] Inventor: Tadao Enomoto, Tanashi, Japan

[73] Assignee: Citizen Watch Company Limited, Tokyo, Japan

[ * ] Notice: The portion of the term of this patent subsequent to Sep. 13, 2000 has been disclaimed.

[21] Appl. No.: 504,099

[22] Filed: Jun. 13, 1983

Related U.S. Application Data

[62] Division of Ser. No. 358,750, Mar. 16, 1982, Pat. No. 4,404,067.

[30] Foreign Application Priority Data

Mar. 24, 1981 [JP] Japan ..... 56-42645
Apr. 14, 1981 [JP] Japan ..... 56-55119

[51] Int. Cl.[3] ..... C25D 1/00; C25D 1/20

[52] U.S. Cl. ..... 204/4

[58] Field of Search ..... 204/3, 4, 6, 9

[56] References Cited

U.S. PATENT DOCUMENTS 3,713,997 1/1973 Anselrode ..... 204/11
3,853,714 12/1974 Shimoda ..... 204/4
4,327,428 4/1982 Enomoto ..... 204/6

*Primary Examiner*—T. M. Tufariello
*Attorney, Agent, or Firm*—Jordan and Hamburg

[57] ABSTRACT

A timepiece display component such as hands and dial plates, which component comprises a first electroformed metal layer having an internal compressive stress, and a second electroformed metal layer formed over said first electroformed metal layer and including an internal tensile stress, such that the internal stresses of the first and second metal layers cancel each other out to reduce the amount of warping distortion in the display component.

6 Claims, 26 Drawing Figures

METHOD OF MANUFACTURING A TIMEPIECE COMPONENT

This is a divisional application of a U.S. patent application Ser. No. 358,750 filed on Mar. 16, 1982 and entitled "METHOD OF MANUFACTURING A TIMEPIECE COMPONENT, now U.S. Pat. No. 4,404,067 issued Sept. 13, 1983.

BACKGROUND OF THE INVENTION

There is an increasing tendancy towards the manufacture of timepieces, generally wristwatches, of increasingly thinner shape. It is therefore becoming increasingly necessary to make all of the components of such a timepiece of reduced thickness, yet to do this without a corresponding loss in mechanical strength or quality of the components. In the case of components of a timepiece dial, such as time indicating hands (in an "analog" type of timepiece) or a dial plate or masking plate (used in a digital timepiece or a combined analog/-digital timepiece), the degree of mechanical strength required is quite low. However if such a component is made extremely thin, using conventional manufacturing methods, then a certain amount of warping, i.e. bending distortion, of the component will generally occur. This distortion is introduced, in the case of a component manufactured by a conventional electroforming method, as a result of the use of a number of superimposed metallic layers within the component, e.g. an electrically conducting base layer necessary in the electroforming process and one or more thicker layers of a metal such as copper formed thereon, constituting the main body of the component. The warping distortion will also generally be increased by any machining, such as grinding or milling, carried out on the electroformed layers to provide a finished surface on the component and to set the desired thickness thereof. The latter warping results from internal stresses produced within the electroformed layers by the machining process itself.

As a result of the warping described above, it has not been possible to manufacture timepiece dial components of extremely thin shape on a mass production basis hitherto, using conventional manufacturing methods, without the cost of manufacture being excessively high. There is therefore a requirement for a method of manufacturing timepiece dial components which are extremely thin, by a simple process which is suited to mass-production, and which will hold the degree of warping of the components to within predetermined narrow limits. Such a method of manufacture is provided by the method of the present invention, which enables timepiece hands, for example, to be manufactured to a thickness of 50 microns, with a degree of warping (measured at one end of the hand with respect to the opposite ends, as described hereinafter), which is within the range +30 microns ($\mu$).

SUMMARY OF THE INVENTION

The present invention contemplates the provision of a timepiece display component such as hands and dial plates, which component comprises a first electroformed metal layer having an internal compressive stress, and second electroformed metal layer formed over said first electroformed metal layer and including an internal tensile stress, such that the internal stresses of the first and second metal layers cancel each other out to reduce the amount of warping distortion in the display component.

DESCRIPTION OF THE PREFERRED EMBODIMENTS

Figure 1:
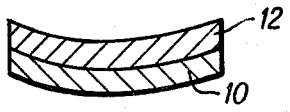
FIG. 1 PRIOR ART
FIG. 1 and FIG. 2 are cross-sectional diagrams for illustrating the effects of different types of internal stress upon electroformed single metal layers formed upon a thin metal base layer.

Referring to FIG. 1, reference numeral 10 denotes a thin metal base layer upon which is an electroformed metal layer 12. It will be assumed that electroformed metal layer 12 has internal tensile stress, as a result of the electroforming process. As illustrated in FIG. 1, which is a cross-sectional diagram of layers 10 and 12, warping (i.e. bending distortion) is produced in the combination of layers 10 and 12, this warping distortion being of concave form, if layer 12 is viewed from above. The warping distortion of electroformed metal layer 12 will persist even if that layer is separated from the base layer 10.

Figure 2:
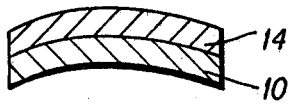
FIG. 2 PRIOR ART

Referring now to FIG. 2, numeral 10 again denotes a thin base metal layer, and numeral 14 denotes an electroformed metal layer which has been formed on base layer 10. It will be assumed that electroformed metal layer contains internal compressive stress. As shown, warping of layers 10 and 14 is of convex shape, as viewed from above the electroformed metal layer 14. In the above examples, it is assumed that thin metal base layer 10 does not have any substantial internal stress, as would normally be true of a conductive layer formed upon an electroforming matrix as a preparatory step before electroforming processing is carried out. In the case of the example of FIG. 2, as for that of FIG. 1, the warping distortion of the electroformed metal layer 14 will persist even if layer 14 is removed from the base layer 10.

Figure 3:
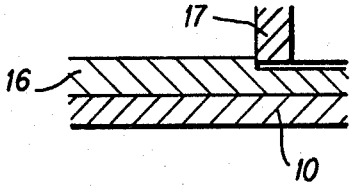
FIG. 3 PRIOR ART
FIG. 3 and FIG. 4 are cross-sectional diagrams for illustrating the effects of internal stress produced by machining of an electroformed metal layer on a thin metal base layer.
Figure 4:
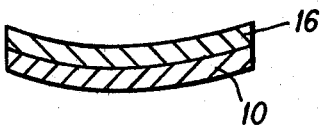
FIG. 4 PRIOR ART

Referring now to FIG. 3, numeral 16 denotes a layer of metal which contains no internal stresses, and which is attached to a thin metal base layer 10. If machining by mechanical means, such as milling or grinding using a tool 17 is carried out on the upper surface of metal layer 16, then it is found that warping distortion will occur as shown in FIG. 4. As shown, concave distortion (as viewed from above layer 16) is produced. This is the type of warping distortion which is produced in an electroformed metal layer having internal tensile stress, such as is illustrated in FIG. 1. For this reason, it can be assumed that internal tensile stress is developed within metal layer 16 as a result of machining the upper surface thereof.

As will be described in the following, the present invention uses the above warping distortion effects which occur within mutually attached metal layers, to produce a very thin timepiece dial component such as a timepiece hand or dial plate, in which such distortion is minimized. This is achieved by using a plurality of electroformed metal layers having variously internal tensile stress and internal compressive stress therein, and by performing mechanical machining work such as milling or grinding upon one of these electroformed metal layers, whereby the effects of the internal stresses in the layer substantially cancel one another out, to thereby reduce the amount of warping distortion which is developed in the completed dial component. This will be made more clear by the specific embodiments of the method of the present invention which are described hereinafter. The application of the method of the present invention to the manufacture of extremely thin timepiece hands will first be described.

Figure 5:
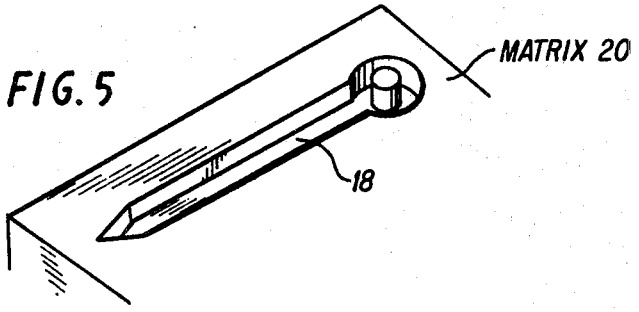
FIG. 5 is an oblique view of a plastic matrix used for electroforming a timpiece hand according to the method of the present invention.
Figure 6:
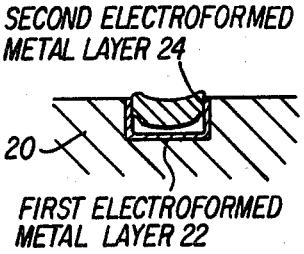
FIG. 6 and FIG. 7 are cross-sectional diagrams for illustrating steps in the manufacture of timepiece hands according to the method of the present invention using the matrix of FIG. 5.

Referring to FIG. 5, numeral 20 denotes a matrix used for electroforming, which is made of synthetic resin or plastic, and is provided with a recessed portion 18 therein. The recessed portion 18 is formed into the shape of a completed timepiece hand (or, more precisely, the sides and lower portion of a completed timepiece hand). Electroforming is then carried out using matrix 20, after a thin conducting base layer 21 has been formed upon the surface of recessed portion 18 as a preparatory step, as shown in FIG. 6. The conducting base layer 21 can comprise a film of copper, formed by any of various means well known in the art. A first electroformed metal layer 22 is then formed upon conducting base layer 21, by an electroforming process as described hereinafter whereby a predetermined type of internal stress, either internal thensile stress or internal compressive stress, is developed within the electroformed metal layer 22. A second electroformed metal layer 24 is then formed over the first electroformed metal layer 22, with the electroforming process being adjusted such that internal stress of the opposite type to that developed within the first electroformed metal layer 22 is produced within layer 24.

It should be noted that although only two electroformed metal layers are shown in this example, it is also possible to use three or more of such layers.

Figure 7:
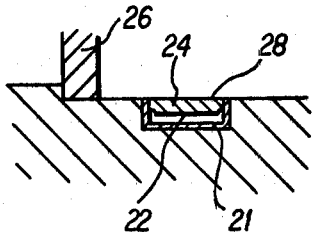

Next, as shown in FIG. 7, mechanical machining suc as milling or grinding is carried out on the surface of second electroformed metal layer 24, using a cutting tool 26. This cutting operation serves to determine the final thickness of the completed timepiece hand, and also has the effect of producing internal tensile stress within second electroformed metal layer 24, as described hereinabove. The mechanically worked face resulting from this machining operation is designated by numeral 28. First and second electro-formed metal layer 22 and 24 are then removed, as a single unit, from matrix 20, and now constitute the completed timepiece hand.

Table 1 given below shows the composition of suitable electrolytes for performing electroforming processing to produce metal layers having either internal tensile stress or internal compressive stress as required.

TABLE 1

| ELECTROLYTE COMPOSITION | | |
|---|---|---|
| | For layer with internal compressive stress | For layer with internal tensile stress |
| Nickel sulfamate | 300 to 600 g/liter | → |
| Nickel chloride | 10 to 30 g/liter | → |
| Boric acid | 30 to 50 g/liter | → |
| Di-sodium saccharin | 0.1 to 10 g/liter | 0. g/liter |
| Sodium lauryl sulfate | 0/1 to 5 g/liter | → |

As shown, the electrolyte for producing internal tensile stress is identical to that for producing internal compressive stress, except for the omission of saccharin di-sodium.

Table 2 below shows suitable electroforming conditions using the electrolytes of Table 1, for forming electroformed metal layers having predetermined internal stresses.

TABLE 2

| ELECTROFORMING CONDITIONS | |
|---|---|
| Current density | 3 to 30 A/dm$^2$ |
| Electrolyte temperature | 25 to 50° C. |
| pH value | 3.5 to 4.5 |
| Agitation | Spray method |

Figure 8:
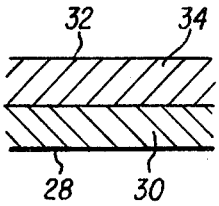
FIG. 8 is a cross-sectional diagram illustrating two electroformed metal layers used in a first embodiment of a timepiece hand manufactured according to the present invention.

Referring now to FIG. 8, the electroformed metal layers which are used in manufacturing a timepiece hand according to a first embodiment of the present invention are shown in a cross-sectional diagram. In this embodiment, two electroformed metal layers 30 and 34 have an internal tensile stress and internal compressive stress respectively, these layers being formed as described hereinabove with reference to FIGS. 5, 6 and 7. With this embodiment, completed timepiece hands were manufactured having a thickness of approximately 50μ. The thickness of each of the electroformed metal layers 30 and 34 was approximately 20 to 30μ so that the overall thickness of the two layers was approximately 40 to 60μ. In FIG. 8, numeral 32 denotes the lower surface of matrix 20, while numeral 28 denotes the surface upon which machining was carried out, i.e. the surface of electroformed metal layer 30 which has internal tensile stress, to bring the overall thickness of the timepiece hand to approximately 50μ, i.e. numeral 28 denotes the top face of the completed timepiece hand.

Figure 9:
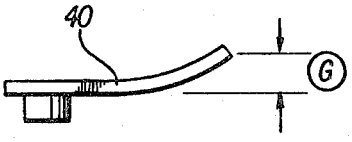
FIG. 9 is a diagram illustrating warping distortion produced in a timepiece hand manufactured according to the first embodiment.
Figure 12:
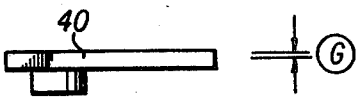
FIG. 12 is a diagram for illustrating warping distortion produced in a timepiece hand manufactured according to the third embodiment.

In the following, the amount of warping distortion of a completed timepiece hand will be designated as positive, by a + sign, if the distortion results in the tip of the hand being deflected upward by some amount. Thus for example as shown in FIG. 9, if the tip is deflected upward by an amount G, then this will be designated as a degree of warping distortion. of +G. A deflection of the tip of the timepiece hand downward by some amount G will be designated as a negative amount of warping distortion, i.e. will be denoted by −G. The limits which were set as the maximum amounts of permissible warping distortion for the 50μ thick timepiece hands of the embodiments described herein were designated as being within a range of G of ±30μ.

For the purposes of comparison, 100 samples of timepiece hands comprising a single electroformed metal layer having internal compressive stress were manufactured and machined to an overall thickness of approximately 50μ. It was found that a maximum amount of warping distortion of 100μ, and an average amount of was produced. Thus, use of such a single layer is not practicable for producing hands which are within the limits for warping distortion stated above. Tests were then made on manufacturing timepiece hands using a single electroformed metal layer having internal tensile stress. However, it was found that this single layer was too soft to be machined in a satisfactory manner, so that such a single layer cannot be used. With the first embodiment of the present invention described above, however, it was found that the maximum degree of warping distortion obtained was −20μ, and the average amount was −10μ, over 100 samples. In other words, the stresses initially present within electroformed metal layer 30 and 34, and the stress which is produced in electroformed metal layer 30 by machining, act to substantially cancel one another out, so that the resultant amount of warping distortion G is held within narrow limits, which are within the specified limits stated above, since the maximum amount of warping distortion produced was −20μ.

Figure 10:
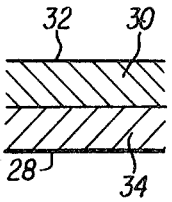
FIG. 10 is a cross-sectional diagram illustrating electroformed metal layers used in a second embodiment of a timepiece hand manufactured according to the present invention.

FIG. 10 is a cross-sectional diagram showing the two electroformed metal layers 30 and 34 used in manufacturing timepiece hands according to a second embodiment of the present invention. In this case, electroformed metal layer 30, having internal tensile stress, was first formed on matrix 20, then electroformed metal layer 34 having internal compressive stress was formed over layer 28. Machining of layer 34 was then carried out to form machined face 28. As in the case of the first embodiment described above, the completed timepiece hands had a thickness of approximately 50μ, with each of electroformed metal layers 28 and 34 having a thickness of 20 to 30μ, for an overall thickness of 40 to 60μ. With this embodiment, the degree of warping distortion produced was a maximum of +100μ over 100 samples, with an average amount of +61μ. Thus, the amount of warping distortion produced wit this embodiment is outside the maximum limits stated previously.

Figure 11:
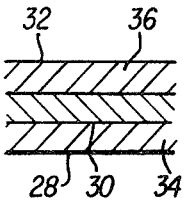
FIG. 11 is a cross-sectional diagram showing three electroformed metal layers used in a third embodiment of a timepiece hand manufactured according to the present invention.

Referring now to FIG. 11, a cross-sectional diagram is shown of three electroformed metal layers 30, 34 and 36 used in manufacturing timepiece hands according to a third embodiment of the present invention. In this case, a layer 30, having internal tensile stress, is sandwiched between layers 34 and 36 which each have internal compressive stress, with each of the layers 34 and 36 having a thickness of 10 to 15μ, and layer 30 having a thickness of 20 to 30μ, so that the overall thickness of the three layers is 40 to 60μ. It was found with this embodiment that the maximum amount of warping distortion produced was +30μ, and the maximum amount was +15μ, over 100 samples. Thus, the amount of warping distortion achieved with the third embodiment is also within the maximum limits specified previously.

Figure 13:
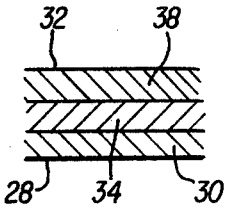
FIG. 13 is a cross-sectional diagram illustrating three electroformed metal layers used in a fourth embodiment of a timepiece hand manufactured according to the present invention.

FIG. 13 is a cross-sectional diagram showing the three electroformed metal layers 30, 34 and 38 of a timepiece hand manufactured according to a fourth embodiment of the present invention. The layers 30 and 38 have internal tensile stress, and each have a thickness of 10 to 15μ, while layer 34 has a thickness of 20 to 30μ, so that the overall thickness of the three layers is 40 to 60μ. The maximum amount of warping distortion obtained with this embodiment was +55μ, and the average amount was +29μ, over 100 samples. Thus, the degree of warping distortion attained with this embodiment is outside the specified maximum limits.

The experimental results described above are summarized in Table 3 below.

TABLE 3

WARPING OF TIMEPIECE HANDS

| Test | | No. of samples | Maximum distortion | Minimum distortion | Average distortion |
|---|---|---|---|---|---|
| 1 | Single electroformed metal layer with internal compressive stress | 100 | +120μ | 30μ | +54μ |
| 2 | Single electroformed metal layer having internal tensile stress | Not practicable due to excessive deformation with machining. | | | |
| 3 | First embodiment | 100 | −20μ | 0μ | −10μ |
| 4 | Second embodiment | 100 | +100μ | +40μ | +61μ |
| 5 | Third embodiment | 100 | +30μ | 0μ | +15μ |
| 6 | Fourth embodiment | 100 | +55μ | +10μ | +29μ |

From the above, it can be understood that timepiece hands having a thickness of approximately 50μ can be manufactured according to the first or the third embodiments of the present invention described above, while will have a maximum degree of warping distortion within the specified limits of ±30μ.

Figure 14:
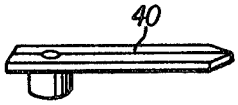
FIG. 14 is an oblique view of an hours or minutes hand manufactured according to the method of the present invention.
Figure 15:
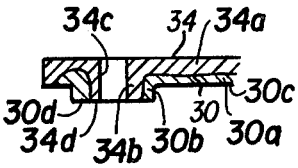
FIG. 15 is a cross-sectional diagram of a hours or minutes hand manufactured according to the first embodiment of the present invention.

FIG. 14 is an oblique view of an example of a completed hours or minutes hand. FIG. 15 is a cross-sectional diagram of an hours or minutes hand comprising two electroformed metal layers 30 and 34, manufactured according to the first embodiment of the present invention described above.

FIG. 15, first electroformed metal layer 34 has an internal compressive stress and includes a flat portion 34*a*, a boss portion 34*b* extending from the flat portion 34*a*, and bore means 34*c* formed through the boss portion 34*b*. On the other hand second electroformed metal layer 30 hs an internal tensile stress and includes a flat portion 30*a*, a boss portion 30*b* formed around an outer wall of the boss portion 34*b* of the first metal layer 34. The boss portions 30*b* and 34*b* have mechanically worked plane surfaces 30*d* and 34*d*, respectively. The flat portion 30*a* of the second metal layer 30 has a mechanically worked surface 30*c*.

Figure 16:
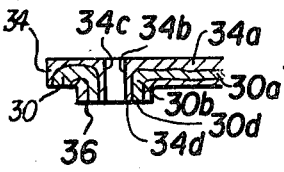
FIG. 16 is a cross-sectional diagram of a hours or minutes hand manufactured according to the third embodiment of the present invention.

FIG. 16 is a cross-sectional diagram of an hours or minutes hand comprising three electroformed metal layer 30,34 and 36, manufactured according to the third embodiment of the present invention described above.

Figure 17:
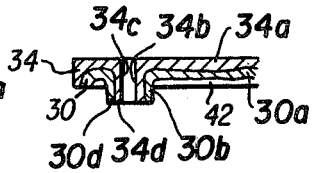
FIG. 17 is a cross-sectional diagram of an hours or minutes hand manufactured according to the first embodiment of the present invention, having a shell type of construction.

FIG. 17 is a cross-sectional diagram of an hours or minutes hand manufactured according to the first embodiment of the present invention described above, in which the hand is formed into a curved shell configuration, i.e. having a lower concave portion 42. It should be noted that the method of the present invention is very suited to the manufacture of timepiece hands having such a shell type of construction, whereby the hands can be made very strong and rigid.

Figure 18:
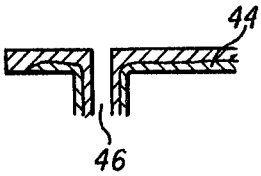
FIG. 18 to FIG. 20 are cross-sectional diagrams of seconds hands manufactured according to the present invention.
Figure 19:
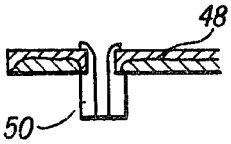
Figure 20:
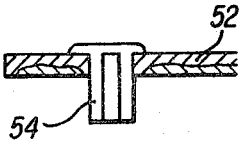

FIG. 18 and FIG. 19 are cross-sectional diagrams of examples of seconds hands manufactured according to the first embodiment of the present invention described above. In the example of FIG. 18, a boss portion 46 is formed as an integral part of the seconds hand 44. In the example of FIG. 19, a boss portion 50 is attached within an aperture in seconds hand 48, by chamfering machining. In the example of FIG. 20, a boss portion 44 having a blind hole therein is press-fitted into the body of a seconds hand 52.

Figure 21:
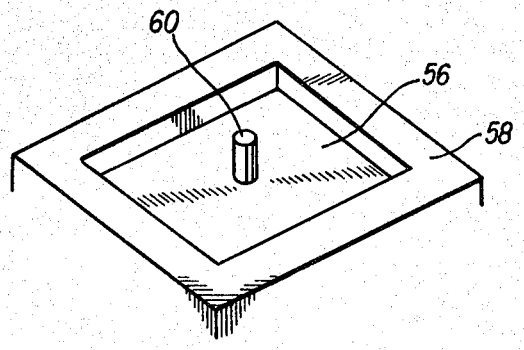
FIG. 21 is an oblique view of an electroforming matrix for use in manufacturing a timepiece dial.
Figure 22:
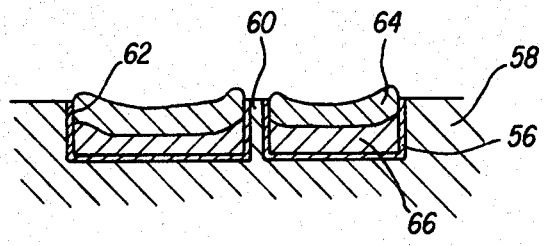
FIG. 22 and FIG. 23 are cross-sectional diagrams for illustrating steps in the manufacture of a timepiece dial according to the method of the present invention.

The method of the present invention is also applicable to the manufacture of extremely thin dial plates or masking plates for miniature timepieces, as will now be described with reference to specific embodiments. Referring first to FIG. 21, the first stage in the manufacture of a dial plate is illustrated, comprising the preparation of a matrix 58, formed of a plastic. A recessed portion 56 and a central protruding portion 60 are provided in matrix 58, with the latter being provided in order to form an aperture for the timepiece hands shafts in the completed dial plate. Next, a thin base layer of conducting material 62 is formed over the surface of recessed portion 56, as shown in the cross-sectional diagram of FIG. 22, with a first electroformed metal layer 66 having a predetermined type of internal stress, either compressive or tensile, being then formed over the base layer 62. A second electroformed metal layer 64, having internal stress of opposite type to that of first electroformed metal layer 66, is then formed over layer 66.

Figure 23:
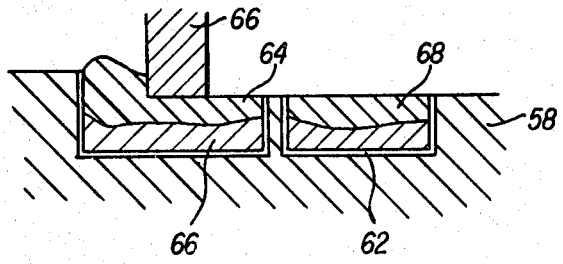

In the next step, as shown in the cross-sectional diagram of FIG. 23, mechanical cutting such as milling or grinding is then performed on the surface of second electroformed metal layer 64, to thereby form a flat machined surface 68 and to determine the overall thickness of the completed dial plate. The electroformed metal layers 64 and 66 are then removed as a unit from matrix 58, and constitute the completed dial plate.

The electrolytes and electroforming conditions described in Table 1 and Table 2 above are suitable for producing the electroformed metal layers of a dial plate or masking plate manufactured according to the present invention. Various dial plates were manufactured and tested, using both single layers of metal having internal stress and using multiple electroformed metal layers according to the method of the present invention, as described hereinafter.

Firstly, tests were performed on dial plates comprising a single electroformed metal layer having internal compressive stress, approximately 40 to 60μ thick, and machining was carried out as described above with reference to FIG. 23 on one surface. It was found that the maximum amount of warping distortion produced was +60μ. In the case of dial plates or masking plates, a convex (i.e. upward) curvature of a plate as viewed from the top (i.e. machined) surface is designated as positive (+), while concave (i.e. downward) warping distortion as viewed from above the top surface is designated as negative (−). As in the case of the timepiece hands described above, the maximum limits for such warping distortion were set as ±30μ. Thus, the degree of warping distortion produced by the single electroformed metal layer with internal compressive stress is outside these limits.

As in the case of the timepiece hands, it was found that a single electroformed metal layer having internal tersile streee was too soft to be machined without excessive deformation, and therefore is not practicable.

Tests were then carried out on dial plates manufactured according to a first embodiment of the present invention, i.e. comprising a first electroformed metal layer 34 having internal compressive stress and a second electroformed metal layer 30 having internal tensile stress, as shown in FIG. 8 and used in the first embodiment of the method of manufacturing timepiece hands. After machining was carried out on the surface of the second electroformed metal layer 30, it was found that the maximum degree of warping distortion produced, over a total of 100 samples, was −10μ, i.e. downward curvature of the dial plate. The thickness of each lectroformed metal layer was approximately 20 to 30μ, so that the total thickness before machining was 40 to 60μ. Thus, with this first embodiment of the method of the present invention for manufacturing dial plates (or masking plates) the degree of warping distortion is within the specified limits.

Dial plates manufactured according to a second embodiment of the present invention were then tested, each comprising a first electroformed metal layer 30 having internal tensile stress and a second electroformed metal layer 34 having internal compressive stress formed over layer 30. Machining of the surface of second electroformed metal layer 34 was then performed, as shown in FIG. 23 above. After this machining, the maximum amount of warping distortion produced in 100 samples was +30μ, so that the dial plates produced using this embodiment of the present invention were also within the specified limits. The thickness of each electroformed metal layer was approximately 20 to 30μ, for an overall thickness before machining of 40 to 60μ.

Dial plates were then manufactured according to a third embodiment of the present invention, from three electroformed metal layers as shown in FIG. 11, i.e. a layer 30 having internal tensile stress which is sandwiched between layers 34 and 36 which each have internal compressive stress. The thickness of each of electroformed metal layers 34 and 36 was 10 to 15μ approximately, and that of electroformed metal layer 30 was approximately 20 to 30μ, so that the overall thickness before machining was 40 to 60μ. With this embodiment, the maximum degree of warping distortion produced over 100 samples was +15μ, so that the dial plates manufactured according to the third embodiment of the present invention are also within the specified limits.

Dial plates were also manufactured according to a fourth embodiment of the present invention, each comprising the three electroformed metal layers 30, 34 and 38 shown in FIG. 13, with layers 30 and 38 having internal tensile stress and each being 10 to 15μ thick, and layer 34 having internal compressive stress and a thickness of 20 to 30μ, giving an overall thickness for the three layers of 40 to 60μ. The maximum degree of warping distortion produced with this embodiment, in 100 samples tested, was +30μ. Thus, the dial plates manufactured according to this third embodiment of the present invention also are within the maximum limits specified above for warping distortion.

The results obtained for dial plates manufactured according to the various methods described above are summarized in Table 4 below.

TABLE 4

WARPING DISTORTION OF DIAL PLATES

| Test | | No. of samples | Maximum degree of distortion |
|---|---|---|---|
| 1 | Single electroformed metal layer having internal compressive stress | 100 | +60μ |
| 2 | Single electroformed metal layer having internal tensile stress | 100 with machining. | Not practicable, due to excessive deformation |
| 3 | First embodiment | 100 | −10μ |
| 4 | Second embodiment | 100 | +30μ |
| 5 | Third embodiment | 100 | +15μ |
| 6 | Fourth embodement | 100 | +30 |

Figure 24:
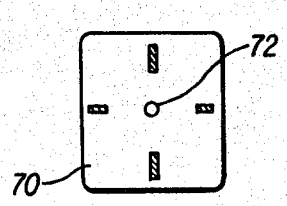
FIG. 24 and FIG. 25 illustrate examples of a timepiece dial and a masking plate respectively.
Figure 25:
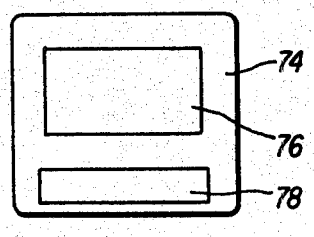

FIG. 24 and FIG. 25 are plan views of a dial plate 70 and a masking plate 74 respectively, suited to manufacture by the method of the present invention. In FIG. 24, numeral 72 denotes a central aperture formed in dial plate 70 for the shafts of the timepiece hands. In FIG. 25, apertures 76 and 78 are formed in masking plate 74 to make visible different parts of a digital display, or to separate a digital display area and an analog display area (in the case of an analog/digital timepiece).

Figure 26:
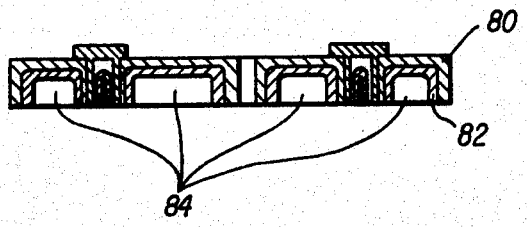
FIG. 26 is a cross-sectional diagram of a timepiece dial manufactured according to the method of the present invention.

FIG. 26 is a cross-sectional diagram of a timepiece dial such as that of FIG. 24, manufactured according to the method of the present invention and having a curved shell type of construction for rigidity. This is manufactured according to the first embodiment described above, comprising a first electroformed metal layer 80 having internal compressive stress and a second electroformed metal layer having internal tensile stress. Numeral 84 denotes curved shell regions of the lower part of the dial plate.

From the above description, it will be understood that the method of the present invention enables timepiece dial components such as dial plates, masking plates, or timepiece hands, to be made extremely thin, yet to have a very low degree of warping distortion. It wil further be understood that timepiece dial components manufactured according to the method of the present invention, composed of a plurality of electroformed metal layers having different types of stress (i.e. either compressive or tensile) developed within the different layers, can be produced inexpensively on mass-production basis.

From the preceding description, it will be apparent that the objectives set forth for the present invention are effectively attained. Since various changes can be made to the above-described method without departing from the spirit and scope of the present invention, it is intended that all matter contained in the above description or shown in the accompanying drawings shall be interpreted in an illustrative and not in a limiting sense. The appended claims are intended to cover all of the generic and specific features of the invention described above.

What is claimed is:

1. A timepiece display component comprising:

a first metal layer formed by electroforming processing step; and a second metal layer formed upon said first metal layer by electroforming processing step;

said first metal layer having an internal compressive stress while said second metal layer has an internal tensile stress such that said internal stresses are arranged to cancel each other out to reduce the amount of warping of said timepiece display component; and said first metal layer including a flat portion, a boss portion extending from said flat portion through said second metal layer, and a bore formed through said boss portion, said second metal layer including a flat portion formed on the flat portion of said first metal layer, and a boss portion formed around an outer wall of the boss portion of said first metal layer.

2. A timepiece display component according to claim 1, in which said first and second metal layers have mechanically worked surfaces at ends of said boss portions, respectively.

3. A timepiece display component according to claim 2, in which the flat portion of said second metal layer has a mechanically worked surface.

4. A timepiece display component according to claim 1, further comprising a third metal layer formed over said second metal layer and having an internal compressive stress.

5. A timepiece display component according to claim 1, in which said second metal layer has a curved shell configuration.

6. A timepiece display component comprising:

a first metal layer formed by electroforming processing step; and a second metal layer formed upon said first metal layer by electroforming processing step;

said first metal layer having an internal compressive stress while said second metal layer has an internal tensile stress such that said internal stresses are arranged to cancel each other out to reduce the amount of warping of said timepiece display component.

* * * * *